US006581790B1

(12) United States Patent
Zadro

(10) Patent No.: US 6,581,790 B1
(45) Date of Patent: Jun. 24, 2003

(54) HEIGHT ADJUSTABLE SHOWER CADDY INTERCHANGEABLY MOUNTABLE TO DIFFERENT STRUCTURES

(76) Inventor: Zlatko Zadro, 5422 Argosy Dr., Huntington Beach, CA (US) 92649

( * ) Notice: Subject to any disclaimer, the term of this patent is extended or adjusted under 35 U.S.C. 154(b) by 0 days.

(21) Appl. No.: 10/035,870

(22) Filed: Dec. 31, 2001

(51) Int. Cl.[7] ..... A47F 5/08
(52) U.S. Cl. ..... 211/119
(58) Field of Search ..... 211/119, 106, 211/181.1; 248/302; D3/901; D6/514, 524, 525

(56) References Cited

U.S. PATENT DOCUMENTS

| | | | | | |
|---|---|---|---|---|---|
| 3,181,702 | A | * | 5/1965 | Raphael | 211/119 |
| 3,789,996 | A | * | 2/1974 | Stroh | 211/106 |
| 3,923,162 | A | * | 12/1975 | Hussey | 211/119 |
| 4,541,131 | A | * | 9/1985 | Sussman | 211/113 |
| 4,598,891 | A | * | 7/1986 | Hanert | 211/119 |
| 4,880,145 | A | * | 11/1989 | McManus | 222/181.2 |
| 5,044,522 | A | * | 9/1991 | Roig et al. | 211/119 |
| 5,180,067 | A | * | 1/1993 | Conaway et al. | 211/119 |
| 5,588,543 | A | * | 12/1996 | Finger | 211/106 |
| 5,620,105 | A | * | 4/1997 | Macek | 211/119 |

* cited by examiner

*Primary Examiner*—Alvin Chin-Shue
*Assistant Examiner*—Sarah Purol
(74) *Attorney, Agent, or Firm*—William L. Chapin

(57) ABSTRACT

A shower caddy for holding personal care articles including containers of preparations such as shampoo, hair conditioner, lotions, toothpaste and the like, and items such as shavers, toothbrushes and combs, includes a frame having generally vertically disposed structural elements, at least one and preferably two transversely disposed shelves for holding articles, the shelves being attached to the frame at a vertically spaced apart locations, and a mirror pivotably attached to the frame at an intermediate vertical location between the shelves. A tubular collar attached parallel to the frame is has a vertically disposed coaxial bore therethrough that telescopically and rotatably holds the elongated straight, lower shank portion of a hanger rod. The hanger rod has formed in the upper end thereof a planar angled and curved hook which includes a front arch-shaped portion that protrudes upwardly from the shank and has an arcuately curved front upwardly concave opening adaptable to be received by and suspended on a shower water supply pipe that protrudes as an arm from a shower enclosure wall. The hook also has a horizontally disposed arm which protrudes rearwardly from the arch, and a leg which protrudes downwardly from the arm, forming with the shank a rectangularly-shaped upwardly concave opening adapted to be received by and suspended on the horizontally disposed upper edge wall of a shower enclosure panel or door. A thumbscrew received in a threaded hole disposed transversely through a wall of the collar and into the bore thereof is loosenable to enable telescopic adjustment of the height of the hanger rod above the caddy frame, and rotation of the plane of the hook to an orientation parallel to the frame, for suspending the hook from a shower arm, or perpendicular to the frame, for suspending the hook from a shower enclosure panel or door, the thumbscrew being than re-tightened onto the shank of the hanger rod to secure the hook at a desired elevation and angular orientation relative to the frame.

44 Claims, 5 Drawing Sheets

40
45
36
35
48
84
30
20
87L
81
49
47
52
82
86
25
98L
96
87R
89L
83
97
88
103
85
98R
94
89R
71
74
76,78
21
75
75
73
76,78
72
24
77
70L
55
23L
23R
50
69L
61
49
53
22
60
70R
68L
63
51
56L
68R
56R
62
65L
54
59
69R
66L
58
65R
57
66R
66R
67L
66L
67R 20
30
52
25
26L
25
26R
21
73
76,78
75
75
76,78
74
71
77
24
23R
50
23L
49
22
51

36
30
20
81
95
96
28,105
106
52
25
94
86
98R
91R
89R
101R
90R
99
26R
104
98L
91L
89L
102
90L
101L
100
26L
92
31
32
21
71
75
76,78
35
77
80
79
23R
50
23L
27
22
49
53
51
107
27,64

HEIGHT ADJUSTABLE SHOWER CADDY INTERCHANGEABLY MOUNTABLE TO DIFFERENT STRUCTURES

BACKGROUND OF THE INVENTION

A. Field of the Invention

The present invention relates to implements for holding personal care articles routinely used in bathroom showers. More particularly, the invention relates to a shower caddy for holding personal care items such as soap, shampoo, wash cloths and the like, which is adjustable in height to suit amuser's preference, and which is interchangeably and conveniently attachable to a shower arm, wall, and exterior or door panel of a shower enclosure or stall.

B. Description of Background Art

Showers used in homes, hotels and other such structures usually are of two main types. One such shower type includes a bathtub, and, located above the tub, a water supply pipe called a shower arm terminating in a spray nozzle head, the arm protruding from a wall forming part of a structure which partially encloses the shower. Access to the bathtub is typically provided through an opening adjacent to a longer side of the tub. Usually, the opening is closeable by a shower curtain slidably mounted on a shower rod which spans the opening near the upper end of the shower enclosure, or by one or more sliding or swinging doors. A second type of shower in common use consists essentially of a relatively smaller enclosure or stall which has a shower arm and head protruding from a wall, and which is closeable by a curtain, or by a sliding or swinging door.

In addition to bar soap or liquid soap and wash cloths customarily used by people in bathroom showers, a variety of other articles related to personal hygiene are frequently used when showering. Such articles include containers of shampoo and hair conditioner, lotions, shavers, shaving cream, combs, brushes, and the like. While some shower enclosures are provided with one or more small shelves or ledges on which such personal hygiene items may be placed, many shower enclosure are devoid of any convenient location of adequate size for storing such items. Moreover, the shelves or ledges provided in typical shower enclosures tend to be relatively small, thereby affording insufficient space for storing articles without the likelihood of the articles being accidentally dislodged and falling to the floor of the shower enclosure.

In recognition of the need for providing primary or additional storage space for articles of personal hygiene used in showers, a wide variety of holders or "shower caddies" for storing such accessory articles have been disclosed and marketed. One type of shower caddy currently available is so constructed as to be readily attached to a shower arm, by hanging the caddy on the arm, for example. Another type of shower caddy presently in use is provided with a hook which permits the caddy to be hung on the outer enclosure panel or door of a shower enclosure. Formerly there were no existing shower caddies which could be readily reconfigured to enable the caddy to be attached to either a shower head or enclosure panel. However, In U.S. patent application No. 09/694,907, filed Oct. 24, 2000, now U.S. Pat. No. 6,520, 351 the present inventor disclosed a Reversible Shower Caddy interchangeably attachable to a shower arm and shower enclosure panel. The caddy described therein includes a pair of laterally spaced apart, straight vertical stanchion rods, each having at the upper end thereof a short upper end arm which protrudes perpendicularly forward from a longer lower portion of the stanchion. An upper transverse bracket member removably attachable at outer lateral ends thereof to the stanchions has a laterally centrally located central arch section having an upwardly concave opening adapted to fit over a shower arm pipe and thereby suspend the caddy frame therefrom. The reversible shower caddy includes a plurality of article storage shelves which are removably attached to the stanchions at adjustable heights, the shelves protruding perpendicularly forward from the stanchions when the caddy is hung from a shower head. A pair of laterally opposed hooks protruding forward from the stanchions each has an outer portion angled downwardly and rearwardly towards a stanchion, forming therebetween an upwardly facing opening for receiving the upper edge of a shower enclosure panel or door. With shelves removed from the front sides of the stanchions and re-attached to the rear sides thereof, the caddy may be positioned with the openings of the hooks above the upper edge wall of a shower enclosure panel or door, thereby enabling the panels to be insertably received within the openings of the hooks, and thereby suspending the caddy on the panel.

The present invention was conceived of to provide a shower caddy which includes means for suspending the caddy interchangeably from a shower arm or enclosure panel at an adjustable height, and which may also be mounted to the wall of a shower enclosure.

OBJECTS OF THE INVENTION

An object of the present invention is to provide a shower caddy for holding personal hygiene articles typically used by a person showering, such as shampoo and soap, the shower caddy including means for interchangeably fastening the caddy to a shower head, wall and enclosure panel.

Another object of the invention is to provide an interchangeably mountable shower caddy which includes a frame including article storage means, and a hanger rod having at an upper end portion thereof means for interchangeably suspending the rod from a shower head and shower enclosure panel, and a lower end portion secureable to the frame at an adjustable height by adjustable fastening means.

Another object of the invention is to provide a shower caddy including a vertically disposed frame having at least one horizontally disposed article storage shelf protruding forward from the frame, the shelf having a flat rear surface secureable to a shower wall by a flat adhesive fastener, and a hanger rod having at an upper end portion thereof a hook portion having a plurality of downward facing openings adapted to suspending the rod interchangeably from a shower head and enclosure wall, and a lower end portion secured to the frame by fastening means enabling adjustment of the height of the frame relative to the hook.

Another object of the invention is to provide a shower caddy including a generally planar, vertically disposed frame having at least one horizontally disposed article storage shelf protruding forward from the frame, a mirror attached to the frame, a flat rear surface securable to a shower enclosure wall by a thin, flat adhesive fastener, and a hanger rod interchangeably suspendable from a shower head and shower enclosure panel and fastened to the frame at an adjustable height.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved shower caddy for holding items typically used in a bathroom shower, e.g., bottles or tubes containing shampoo, hair conditioner and other such preparations, as well as wash cloths, shavers, combs, hair brushes, tooth brushes and the like. A shower caddy according to the present invention includes a vertically disposed, planar wire frame and at least one article storage shelf attached to the frame. Preferably, the caddy has upper and lower article storage shelves located above and below a face mirror attached to the frame. The shower caddy according to the present invention includes a vertically disposed hanger rod which protrudes upwardly from the frame at an adjustable height. In a preferred embodiment, height adjustability is provided by a lower straight, shank portion of the hanger rod being vertically slidably held within the longitudinally disposed bore of a tubular frame member. The shank is frictionally secured at an adjustable height by tightening onto the shank the inner end of a thumb screw received in a radially disposed hole which penetrates the bore and an external wall of the tubular member.

According to the invention, the hanger rod, which preferably is fabricated from steel rod stock bent into uniplanar shape, is provided at the upper end of a straight lower shank portion thereof with an angled and curved hook portion having an upwardly concave arch-shaped portion, a rearwardly disposed horizontal arm, and a vertically disposed rear leg terminated at the lower end thereof by an upwardly curved rear end portion capped by a ball. With the shank of the hanger rod rotated within the tubular frame member bore to orient the plane of the hanger rod parallel to the frame, the caddy is conveniently attachable to a tubular shower pipe or arm by lifting the caddy to position the arc-shaped portion of the hanger rod over the shower arm, thereby suspending the hanger rod and caddy frame from the shower head. With the shank of the hanger rod rotated to orient the plane of the hook portion of the hanger rod perpendicular to the plane of the frame, the caddy is conveniently attachable to a relatively thin shower enclosure panel or door by positioning the arch-shaped portion of the hanger rod over the upper horizontal edge of the panel or door, thereby suspending the hanger rod and caddy frame from the shower head. Similarly, the caddy can be suspended from a relatively thicker shower enclosure or door panel by positioning a rectangularly-shaped, upwardly concave opening formed between the shank, the rear leg and rear horizontal arm of the hanger rod hook, and the upper vertical end portion of the hanger rod shank, over the upper edge of the panel or door. A preferred embodiment of a height adjustable shower caddy according to the present invention includes upper and lower trays having coplanar vertically disposed rear surfaces, which are optionally provided with pressure sensitive adhesive pads which may be used to secure the caddy to a wall.

DESCRIPTION OF THE PREFERRED EMBODIMENTS

FIGS. 1–6 illustrate a height adjustable shower caddy interchangeably mountable to shower arms, walls and enclosure panels according to the present invention.

Figure 1:
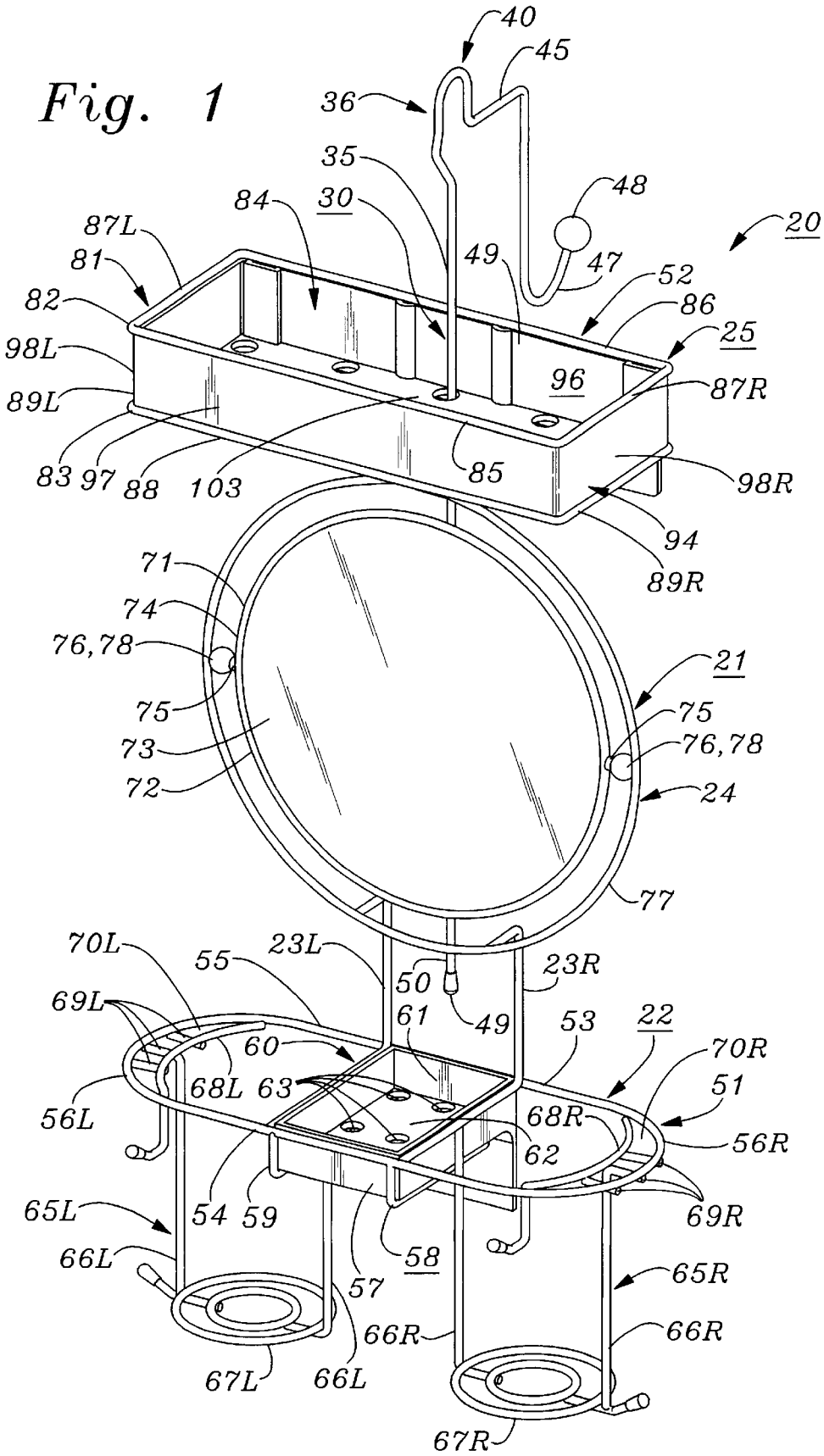
FIG. 1 is an upper front perspective view of a height-adjustable shower caddy interchangeably mountable to shower heads, walls and enclosure panels according to the present invention.
Figure 2:
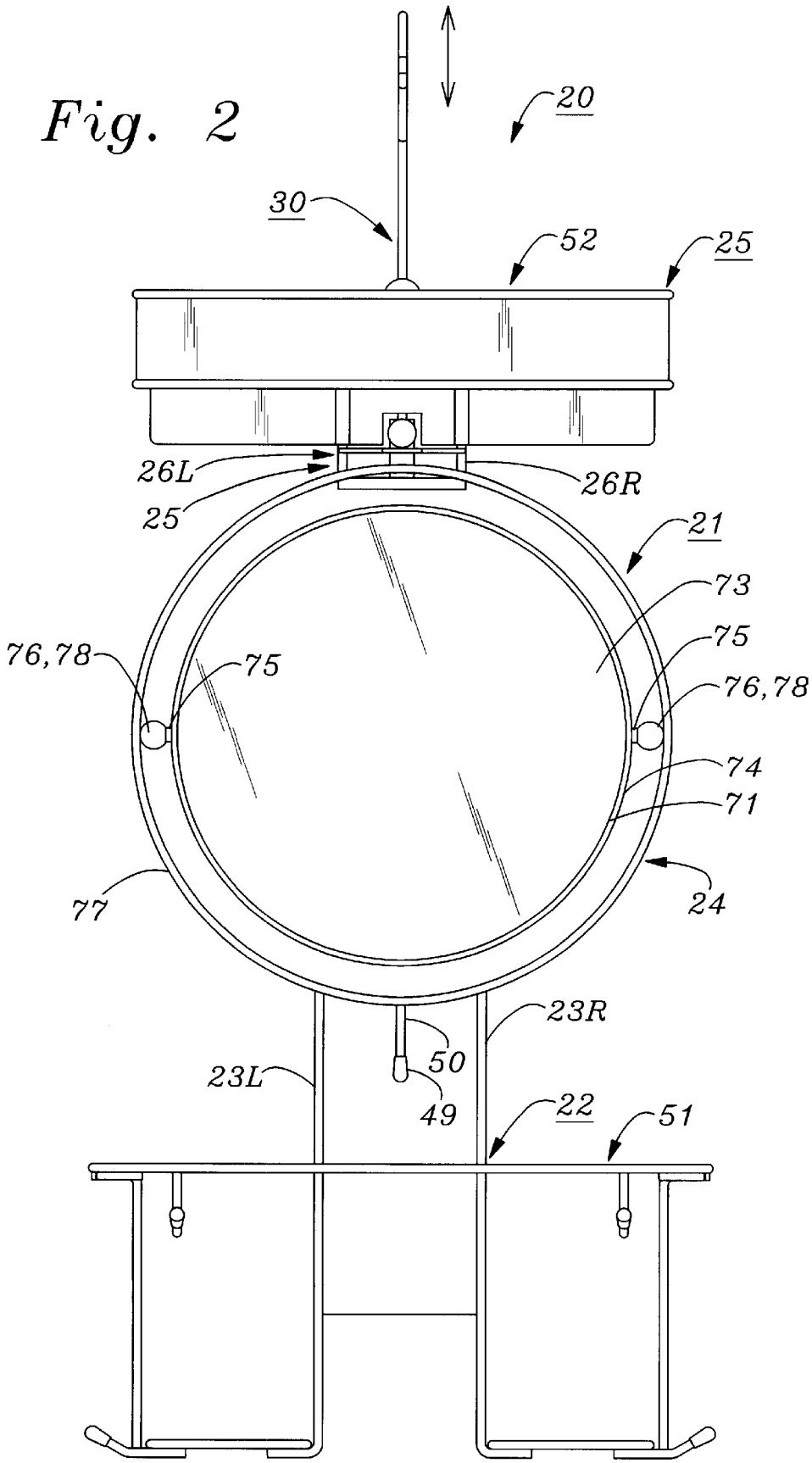
FIG. 2 is a front elevation view of the shower caddy of FIG. 1.
Figure 3:
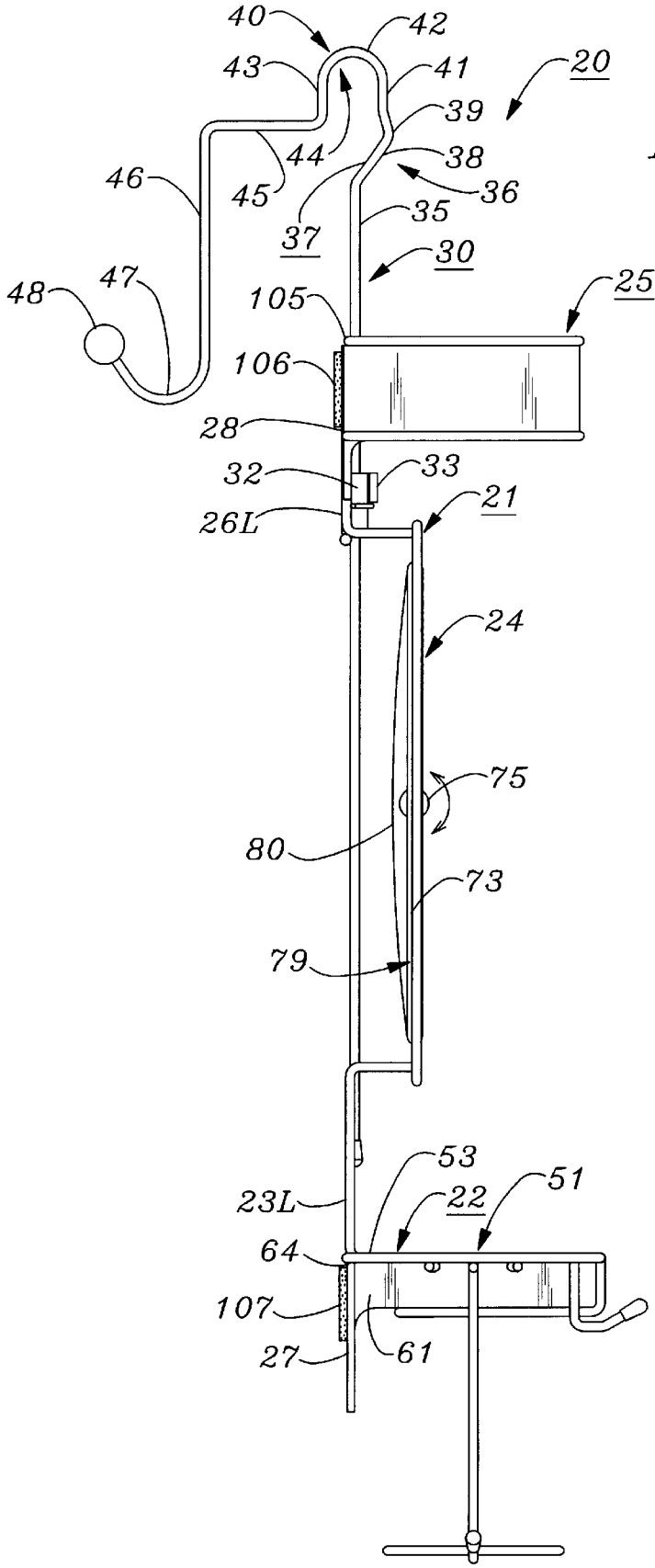
FIG. 3 is a left side elevation view of the shower caddy of FIG. 1, the right side elevation view thereof being a mirror image of FIG. 3.

Referring first to FIGS. 1–4, a height adjustable shower caddy 20 according to the present invention may be seen to include a generally vertically disposed frame 21 which has a lower portion 22 comprised of left and right vertically disposed, parallel left and right lower stanchion members 23L, 23R, respectively; an intermediate circular ring-shaped frame portion 24 parallel to and offset forward from the plane of the lower stanchion members; and an upper frame portion 25 comprised of left and right vertically disposed, parallel left and right upper stanchion members 26L, 26R, respectively. As shown in FIG. 3, lower and upper frame portions 22 and 25 have rear surfaces 27, 28, respectively, which are coplanar and offset rearwardly from a plane 29 tangent to the rear surface of intermediate ring-shaped frame portion 24.

As shown in FIGS. 1–4, shower caddy 20 includes a laterally centrally located, vertically disposed hanger rod 30 which protrudes upwardly from upper frame portion 25. Hanger rod 30 is a unitary, uni-planar element which has an elongated, straight lower shank portion 35, and an upper angled and curved planar hook portion 36. Shank 35 of hanger rod is vertically slidably held within slidably held within a bore 31 disposed coaxially through a tubular member 32 fastened to upper frame portion 25, and secured within the bore at and adjustable height by a thumb screw 33 screwed into a threaded hole (not shown) disposed radially through a cylindrical wall of the tubular member. Shank 35 of hanger rod 30 is also rotatable about its longitudinal axis within tubular member 32, when thumb screw 33 is loosened. Hanger rod 30 may be rotated to position the plane of an upper angled and curved hook portion 36 of hanger rod 30 parallel to frame 21, or perpendicular to the frame, as shown in FIG. 1, and secured in the respective position by tightening thumb screw 33 to thereby frictionally engage shank 35 of the hanger rod with the inner end of the thumbscrew.

Referring now to FIG. 3, it may be seen that hook 36 of hanger rod 30 has a lower portion 37 which includes a lower straight leg 38 that angles forward from the longitudinal axis of hanger rod shank 35, and a shorter straight upper leg 39 which angles rearwardly from lower leg 38. Rearwardly angled straight upper leg 39 of hanger rod 30 is joined at the upper end thereof to the lower end of a front vertical leg 41 of an arch-shaped upper portion 40, which includes an accurately curved upper portion 42 and a rear vertical leg 43. Thus constructed, arch-shaped upper portion 40 has an upwardly concave opening 44 which is adapted to fit over a shower arm, or a relatively thin shower enclosure panel or door. With hook 36 of hanger rod 30 oriented parallel to frame 22, the hanger rod and attached shower caddy frame 21 may be suspended from a shower arm.

Referring still to FIG. 3, it may be seen that hook 36 of shower caddy hanger rod 30 has a horizontally disposed arm 45 which protrudes rearwardly from a lower end of rear vertical leg 43 of arch section 40. Hook 36 also includes a relatively long, vertically disposed rear leg 46 which protrudes perpendicularly downwards from a rear end of horizontal arm 45. Thus constructed, hook 36 of shower caddy hanger rod 30 has formed therein a generally rectangularly-shaped, upwardly concave opening 47 which is adapted to fit over the upper edge wall of a relatively thick shower enclosure panel or door, thus suspending the hanger rod and attached shower caddy frame 21 from such a panel or door when the plane of the hook is oriented perpendicularly to frame 21.

In a preferred embodiment of a hanger rod 30 according to the present invention, a lower end portion of rear vertical leg 46 has an arcuately, upwardly curved end portion 47 terminated by a ball 48, thus providing a hanger for conveniently supporting towels and the like outside a shower enclosure.

Hanger rod 31 is preferably fabricated as a unitary structure from stainless steel rod stock. Also, as shown in FIGS. 1–4, a cap 49 is fitted to lower end 50 of rod 30, to prevent the end of the rod from sliding through bore 31 of tubular member 32 when thumbscrew 33 is loosened, and thereby preventing frame 21 from inadvertently becoming disengaged from the hanger rod.

Referring now to FIGS. 1 and 2, it may be seen that shower caddy 20 includes at least one shelf, e.g., a lower shelf 51 which is disposed laterally with respect to left and right lower stanchion members 23L, 23R, and which protrudes horizontally forward of the lower stanchion members. Preferably, as shown in FIGS. 1 and 2, shower caddy 20 also preferably includes a horizontally disposed upper shelf 52 which protrudes forward of upper stanchion members 26L, 26R.

In a preferred embodiment of a shower caddy 20 according to the present invention, frame 21 and shelves 51, 52 are all fabricated from steel rod stock which is bent and welded to form those structures. Thus, as shown in FIGS. 14, lower shelf 51 includes an upper horizontally disposed planar frame section 53 made of steel rod stock bent into a race track-like profile including front and rear elongated parallel straight portions 54 and 55, respectively, and left and right arcuately curved outwardly convex end portions 56L, 56R. Lower shelf 51 also includes a bar soap storage compartment 57 having a longitudinally elongated rectangular-shape and located laterally midway between end portions 56L, 56R of shelf frame section 53. Soap storage compartment 57 includes an exterior downwardly concave skeletal support structure 58 comprised of steel rod stock members 59 which depend downwardly from shelf frame section 53. Preferably, soap storage compartment 57 contains conformally within a hollow upper space 60 thereof a rectangularly shaped soap tray 61 having through a bottom wall 62 thereof a plurality of water drain holes 63. Also, as shown in FIG. 3, soap tray 61 preferably has a flat, vertically disposed rear wall surface 64.

Referring still to FIGS. 1–3, it may be seen that lower shelf 51 of shower caddy 20 includes left and right skeletal, vertically elongated tubular article holders 65L, 65R formed of rod stock members 66 which depend downwardly from upper shelf frame section 53, and which are adapted to hold cylindrical containers for shaving cream, shampoo, hair conditioner and the like. Holders 65L, 65R include at the bottom ends thereof transversely disposed members 67 for supporting containers of the type described. Also, as shown in FIGS. 1 and 2, upper shelf frame section 53 has inward of left and right curved end portions 56L, 56R thereof concentric curved members 68L, 68R joined thereto by a plurality of radially disposed members 69L, 69R to form therewith sector-shaped openings 70 in which may be held toothbrushes, shavers, razors, and other such articles having thin, elongated handles.

Figure 4:
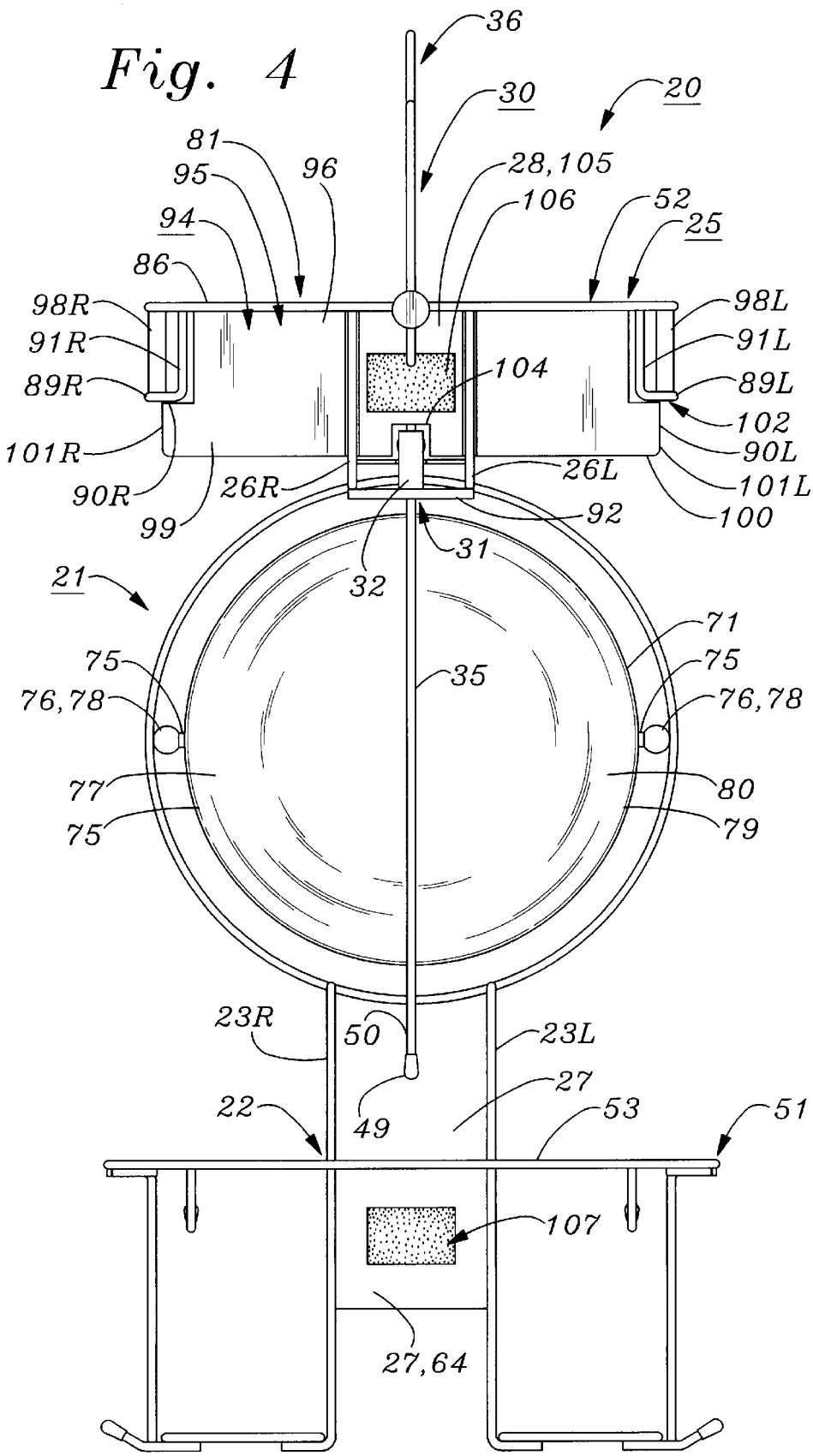
FIG. 4 is a rear elevation view of the shower caddy of FIG. 1.
Figure 5:
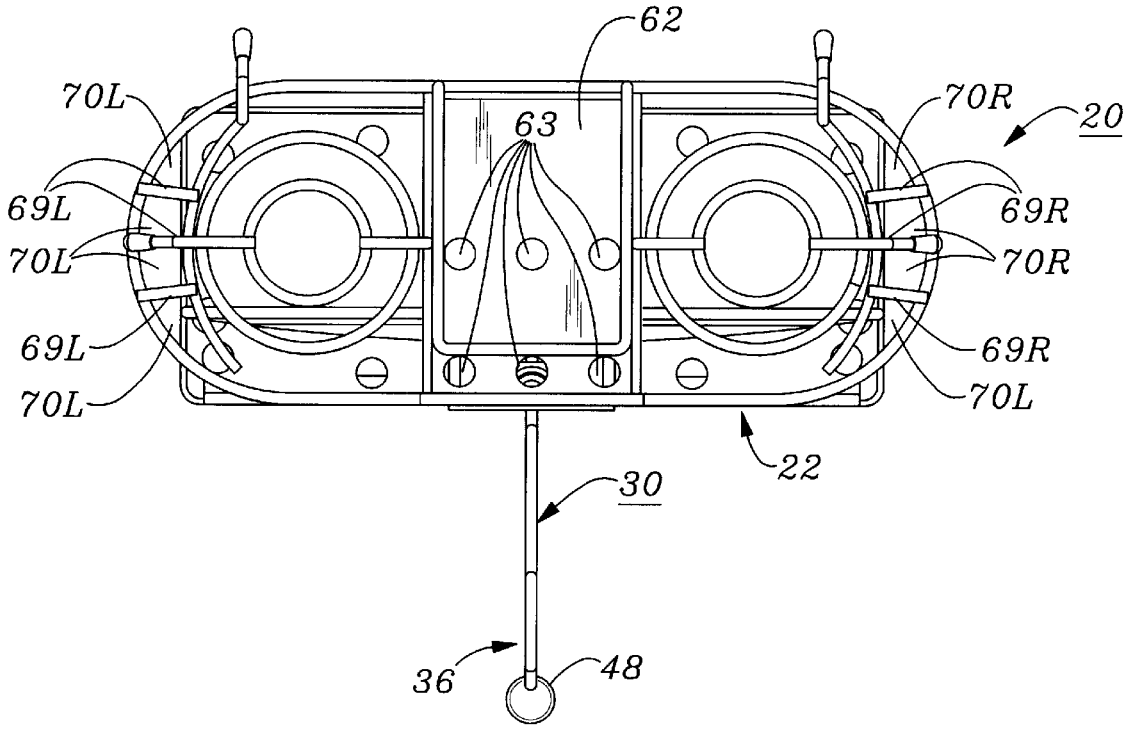
FIG. 5 is a bottom plan view of the shower caddy of FIG. 1.
Figure 6:
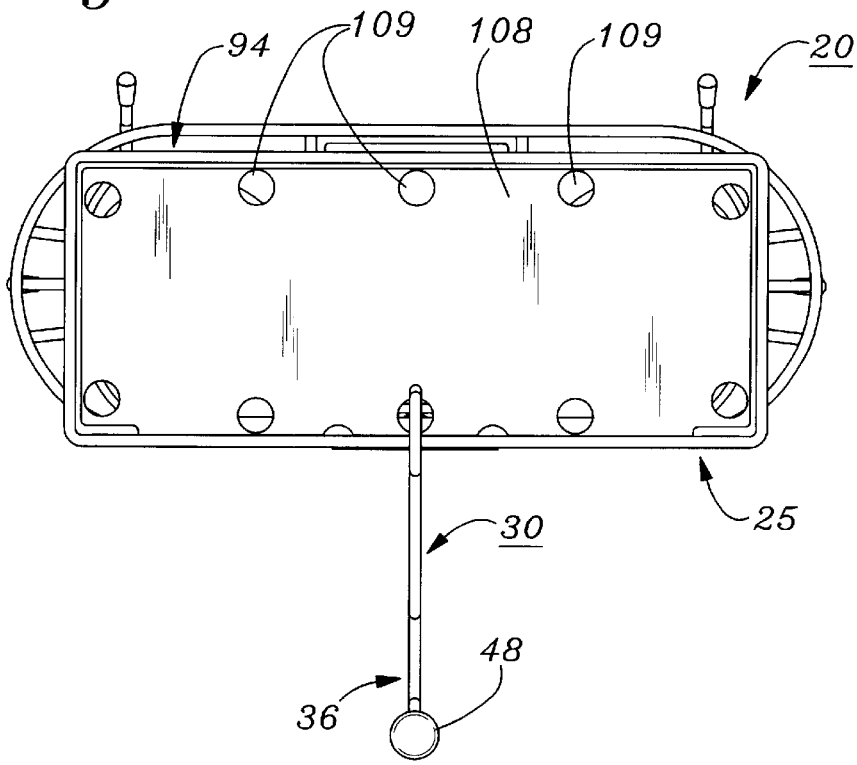
FIG. 6 is an upper plan view of the shower caddy of FIG. 1.

Referring now to FIG. 4 in addition to FIGS. 1–3, it may be seen that left and right lower stanchion members 23L, 23R which join intermediate circular ring-shaped portion 24 of shower caddy frame 21 to lower portion 22 of the frame protrude vertically upwardly from the straight horizontally disposed rear portion of upper frame member section 53 of lower shelf 51. As shown in those figures, lower stanchion members 23L, 23R are spaced laterally equidistant from a vertical center plane perpendicular to frame 21, and have rear surfaces which lie in a vertical plane offset slightly forward of rear surface 64 of soap tray 61.

Referring now mainly to FIGS. 1, 2, and 3, it may be seen that intermediate circular ring portion 24 of frame 21 holds concentrically and pivotably adjustably therewithin a circular disk-shaped mirror support plate 71. As shown in those figures, mirror support plate 71 has fastened concentrically to a front surface 72 thereof a circular mirror 73 which is slightly smaller in diameter than the support plate. In a preferred embodiment, mirror support plate 71 is made of a synthetic polymer such as nylon, polycarbonate or the like, and is provided at the outer peripheral edge thereof with a raised annular ridge 74. With this construction, mirror 73 is fitted within ridge 74 and secured to frame surface 72 of mirror support plate by an adhesive fastener (not shown).

As shown in FIGS. 1–4, mirror support plate 71 has located at each opposite lateral end of a horizontal diameter thereof a radially outwardly protruding, generally spherically-shaped ball end 75 made of an elastically deformable material which is forcibly inserted into a metal cup 76 which protrudes laterally inwards from each side of a metal ring 77 comprising intermediate ring-shaped portion 24 of frame 21. Each ball end 75 fits into a generally hemispherically-shaped cavity 78 formed within cup 76, restrained against lateral motion but pivotable about the horizontally disposed diameter of mirror support plate 71 containing the ball ends, thus enabling the mirror plate and mirror 73 to be tilted to a desired viewing angle.

As shown in FIGS. 3 and 4, mirror support plate 71 has a flat rear surface 79 to which a second rear mirror plate 80 may be fastened. With this arrangement, front and rear mirrors 73 and 80 may have different magnifications, 1X and 5X, for example, which may be alternately selected by unhooking shower caddy 20 from it support means, and rotating mirror plate 180 degrees about a horizontal pivot axis through mirror support ball ends 75.

Referring still to FIGS. 1–4, it may be seen that upper shelf 52 has an exterior skeletal frame 81 which includes an upper laterally elongated rectangular ring-shaped frame section 82 and a lower similarly shaped frame section 83 vertically aligned with the upper frame section to form therebetween a laterally enlarged, rectangular box-shaped space 84. As shown in FIG. 1, upper frame section 82 has front and rear laterally disposed, horizontal members 85 and 86, and left and right longitudinally disposed side members 87L, 87R, respectively. Lower ring-shaped frame section 83 has a front laterally disposed member 88, and left and right side members 89L, 89R, which protrude perpendicularly rearwards from opposite outer lateral ends of the front members. As may be seen best by referring to FIG. 4, side members 89L, 89R are bent laterally inwardly at rear end portions thereof to form short, laterally inwardly disposed legs 90L, 90R in vertical alignment with rear laterally disposed member 85 of upper frame section 82, and then vertically upwardly to form parallel, vertically disposed, laterally spaced apart vertical side members 91L, 91R which are joined at the upper ends thereof to a lower edge of rear member 86 of upper frame section 82. As is also shown in FIG. 4, intermediate ring-shaped portion 24 of shower caddy frame 21 has joined to ring 77 thereof near an upper horizontal tangent edge thereof a short laterally disposed straight strut 92, outer lateral ends of which are attached to and support left and right upper stanchion members 26L, 26R. Upper stanchion members 26L, 26R are fastened to laterally disposed rear member 86 of upper frame section 82, thus supporting upper shelf frame 81.

As shown in FIGS. 1–4, laterally elongated rectangular box-shaped space 84 between upper and lower rectangular frame sections 82 and 83 of upper shelf 52 preferably holds a similarly shaped upper shelf tray 94. As may be seen best by referring to FIG. 4, upper shelf tray 94 preferably has a flat rear wall panel 95 which has an upper portion 96 that has the same height as front, left and right side walls 97, 98L, 98R, respectively. Rear wall panel 95 also has a lower laterally elongated rectangularly shaped tab portion 99 that has a horizontally disposed lower edge 100, and left and right vertically disposed edges 101L, 101R which are offset laterally inwards of left and right side walls 98L, 98R of upper shelf tray 95. Tab 99 fits downwardly through a rectangularly shaped opening 102 in lower shelf frame section 83, with bottom wall 103 of upper shelf tray 94 supported by the lower shelf frame section.

As may be seen best by referring to FIGS. 3 and 4, lower tab portion 99 has formed therein a laterally centrally located, vertically elongated rectangularly shaped notch 104 which protrudes upwardly from lower edge 100 of the lower tab portion. As is also shown in FIGS. 3 and 4, tubular hanger support member 32 is fastened to the front surface of horizontally disposed strut 92 at the upper end of ring-shaped member 24, and protrudes upwardly through notch 104 in bottom edge wall 100 of tab 99. With this construction, tubular hanger support member 32 is located forward of rear face 105 of upper shelf tray 94, thereby allowing the rear face of the upper shelf tray to be coplanar with rear face 64 of lower soap tray 61. Accordingly, as shown in phantom in FIG. 4, thin, double-stick, pressure sensitive adhesive pads 106, 107 may be adhered to the rear surfaces of upper shelf tray 94 and lower soap dish tray 61, and the rear surfaces of the pressure sensitive adhesive pads pressed against the wall of a shower enclosure, thus providing a third alternative means of mounting shower caddy 20 in addition to the two shown in FIGS. 7 and 8 and described above. As may be seen best by referring to FIG. 6, lower wall 108 of upper shelf tray 94 preferably is provided with a plurality of spaced-apart water drain holes 109.

As shown by the double headed arrow in FIG. 4, shank 35 of hanger rod 30 may be slid vertically within bore 31 of tubular frame member 32 when thumb screw 33 is loosened, thus allowing adjustment of height of frame 21 relative to a shower head or enclosure door or panel from which hook 36 of the hanger rod is hung.

What is claimed is:

1. A shower caddy for holding articles usable in a bathroom shower provided with a shower head including an arm terminated by a spray nozzle, and an enclosure, said caddy comprising;

f. a frame, g. at least a first shelf attached to said frame for holding articles, h. a hanger rod having a shank terminated at an upper end thereof by a hook for suspending said hanger rod from a structure, said hook having a first, upwardly concave portion adapted to receive and be supported by a shower arm, and a second, upwardly concave portion adapted to receive and be supported by an upper horizontal edge wall of a shower enclosure door or panel, i. longitudinally and rotatably adjustable fastening means for securing said shank of said hanger rod to said frame at an adjustable distance below said hook, and at an adjustable polar angle between said frame and a plane containing said shank and said hook, thereby enabling adjustment of relative angular orientation between said plane and said frame, and j. whereby said hook is rotatable to orientate said plane of said hook parallel to said frame and securable thereat to suspend said first concave portion of said hook from a shower arm and rotatable to orientate said plane of said hook perpendicular to said frame and securable thereat to suspend said second concave portion of said hook from a shower enclosure door or panel.

2. The caddy of claim 1 wherein said frame is further defined as having at least a first generally flat rear surface parallel to said shank of said hanger rod, for adhesively adhering said surface to a vertically disposed wall.

3. The caddy of claim 1 wherein said first shelf is further defined as being an upper shelf having through a lower horizontally disposed surface thereof an aperture for rotatably and vertically translatably receiving said shank of said hanger rod.

4. The caddy of claim 3 further including a second, lower shelf attached to said frame at a location spaced below said first, upper shelf.

5. The caddy of claim 4 further including a mirror attached to said frame between said upper and lower shelves.

6. The caddy of claim 5 wherein said mirror is mounted to said frame by pivot means enabling rotation of said mirror relative to said frame.

7. The caddy of claim 5 wherein said mirror is mounted to said frame by pivot means enabling rotation of said mirror about an axis parallel to said frame.

8. The caddy of claim 7 wherein said axis is further defined as being horizontally disposed.

9. The caddy of claim 1 wherein said adjustable fastening means is further defined as comprising in combination a tubular member attached to said frame, said member having a longitudinally disposed bore which rotatably and telescopically receives said shank of said hanger rod, and an adjustable frictional member tightenable onto said shank to restrain relative motion between said shank and said tubular member.

10. The caddy of claim 9 wherein said adjustable frictional member is further defined as being a thumbscrew screwed into a radially disposed threaded hole which penetrates both said longitudinally disposed bore and an external wall surface of said tubular member.

11. A shower caddy for holding articles usable in a bathroom shower provided with a shower head including an arm terminated by a spray nozzle, and an enclosure, said caddy comprising;

e. a frame, f. at least a first shelf attached to said frame, for holding articles, g. a hanger rod having a shank terminated at an upper end thereof by a hook, said hook having a first portion adapted to be supported by a shower arm with said hook oriented in a first plane relative to said frame, and a second portion adapted to be supported by an upper horizontal edge wall of a shower enclosure door or panel with said hook oriented in a second plane relative to said frame, and h. rotatably adjustable fastening means for securing said hanger rod to said frame with said hook oriented in either of said first and second planes.

12. The caddy of claim 11 wherein said rotatably adjustable fastening means is further defined as enabling securement of said shank of said hanger rod at an adjustable polar angle, thereby enabling adjustment of relative angular orientation between said hanger rod hook and said frame.

13. The caddy of claim 12 wherein said hook is further defined as having a first, upwardly concave arch-shaped opening adapted to receive and be supported by a shower arm.

14. The caddy of claim 13 wherein said hook is further defined as having a second, upwardly concave rectangularly-shaped opening adapted to receive and be supported by an upper horizontal edge wall of a shower enclosure door or panel.

15. The caddy of claim 14 wherein said frame is further defined as having at least a first generally flat rear surface parallel to said shank of said hanger rod, for adhesively adhering said surface to a vertically disposed wall.

16. The caddy of claim 14 wherein said first shelf is further defined as being an upper shelf having through a lower horizontally disposed surface thereof an aperture for rotatably and vertically translatably receiving said shank of said hanger rod.

17. The caddy of claim 16 further including a second, lower shelf attached to said frame at a location spaced below said first, upper shelf.

18. The caddy of claim 17 further including a mirror attached to said frame between said upper and lower shelves.

19. The caddy of claim 18 wherein said mirror is mounted to said frame by pivot means enabling rotation of said mirror relative to said frame.

20. The caddy of claim 18 wherein said mirror is mounted to said frame by pivot means enabling rotation of said mirror about an axis parallel to said frame.

21. The caddy of claim 20 wherein said axis is further defined as being horizontally disposed.

22. The caddy of claim 11 wherein said adjustable fastening means is further defined as enabling securement of said hanger rod to said frame at an adjustable distance below said hook.

23. The caddy of claim 22 wherein said adjustable fastening means is further defined as comprising in combination a tubular member attached to said frame, said member having a longitudinally disposed bore which rotatably and telescopically receives said shank of said hanger rod, and an adjustable frictional member tightenable onto said shank to restrain relative motion between said shank and said tubular member.

24. The caddy of claim 23 wherein said adjustable frictional member is further defined as being a thumbscrew screwed into a radially disposed threaded hole which penetrates both said longitudinally disposed bore and an external wall surface of said tubular member.

25. A shower caddy for holding articles usable in a bathroom shower provided with a shower head including an arm terminated by a spray nozzle, and an enclosure, said caddy comprising;

a. a frame including at least a first vertically disposed structural member, b. at least a first shelf disposed transversely to said first vertically disposed structural member held in fixed relationship thereto, c. a hanger rod having a shank terminated at an upper end thereof by a hook for suspending said hanger rod from a structure, and d. rotatably adjustable fastening means securing said hanger rod to said frame with said hook oriented at an adjustable polar angle relative to said frame.

26. The caddy of claim 25 wherein said adjustable fastening means is further defined as enabling securement of said hanger rod to said frame at an adjustable distance below said hook.

27. The caddy of claim 26 wherein said adjustable fastening means is further defined as comprising in combination a tubular member attached to said frame, said member having a longitudinally disposed bore which rotatably and telescopically receives said shank of said hanger rod, and an adjustable frictional member tightenable onto said shank to restrain relative motion between said shank and said tubular member.

28. The caddy of claim 27 wherein said adjustable frictional member is further defined as being a thumbscrew screwed into a radially disposed threaded hole which penetrates both said longitudinally disposed bore and an external wall surface of said tubular member.

29. The caddy of claim 27 wherein said frame is further defined as including a first, lower, vertical portion having parallel structural elements, a second, intermediate portion having parallel vertical elements, and a third, upper portion having parallel vertical elements.

30. The caddy of claim 29 wherein said first, lower structural elements lie in a first, lower plane, said second, lower structural elements lie in a second, intermediate plane, and said third, upper structural elements lie in a third, upper plane.

31. The caddy of claim 30 wherein said first, second and third planes are mutually parallel.

32. The caddy of claim 31 wherein said second plane is offset forward of said first and second planes.

33. The caddy of claim 32 wherein said first and second planes are co-planar.

34. The caddy of claim 31 wherein said first shelf is further defined as being an upper shelf having through a lower horizontally disposed surface thereof an aperture for rotatably and vertically translatably receiving said shank of said hanger rod.

35. The caddy of claim 34 further including a second, lower shelf attached to said lower portion of said frame.

36. The caddy of claim 35 further including a mirror attached to said intermediate portion of said frame.

37. The caddy of claim 36 wherein said intermediate portion of said frame includes a ring.

38. The caddy of claim 37 wherein said mirror is located within said ring.

39. The caddy of claim 37 wherein said mirror is located concentrically within said ring.

40. The caddy of claim 39 wherein said mirror is further defined as mounted within said ring by pivotable mounting means.

41. The caddy of claim 40 wherein said pivotable mounting means is further defined as including in combination a pair of protuberances protruding radially outwardly from opposite ends of a diameter of said mirror, and a pair of pivot socket elements protruding radially inwardly from opposite ends of a diameter of said ring, each of said pivot coupling elements pivotably holding a separate one of said protuberances.

42. The caddy of claim 41 wherein each of said pair of protuberances is defined as having a generally spherically contoured, ball-shaped end.

43. The caddy of claim 42 wherein each of said pair of pivot socket elements is further defined as having a generally spherically contoured concave cavity rotatably holding therewithin said ball-shaped end of said protuberance.

44. The caddy of claim 25 wherein said hook is further defined as having a first, upwardly concave opening adapted to receive and be supported by a shower arm with said hook oriented at a first polar angle relative to said frame, and a second upwardly concave opening adapted to receive and be supported by an upper horizontal edge wall of a shower enclosure door or panel, with said hook oriented at a second polar angle relative to said frame.

* * * * *